United States Patent [19]

Umemoto et al.

[11] 4,135,843

[45] Jan. 23, 1979

[54] EROSION CONTROL MAT

[75] Inventors: Tomoji Umemoto, Nagoya; Yukichi Nakamura, Tokyo, both of Japan

[73] Assignee: Construction Techniques, Inc., Cleveland, Ohio

[21] Appl. No.: 817,785

[22] Filed: Jul. 21, 1977

[30] Foreign Application Priority Data

Jul. 27, 1976 [JP] Japan ..... 51-89506

[51] Int. Cl.[2] ..... E02B 3/12

[52] U.S. Cl. ..... 405/18; 405/19

[58] Field of Search ..... 61/38, 37, 3–5, 61/1; 47/33, 56, 57.6, 25

[56] References Cited

U.S. PATENT DOCUMENTS

| | | | |
|---|---|---|---|
| 1,629,315 | 5/1927 | Scott | 61/38 X |
| 3,396,542 | 8/1968 | Lamberton | 61/38 |
| 3,425,227 | 2/1969 | Hillen | 61/38 |
| 3,517,514 | 6/1970 | Visser | 61/38 |
| 3,561,219 | 2/1971 | Nishizawa et al. | 61/38 |
| 3,696,623 | 10/1972 | Heine et al. | 61/38 |
| 3,811,287 | 5/1974 | DeWinter | 61/38 |

*Primary Examiner*—Dennis L. Taylor

[57] ABSTRACT

An erosion control mat of textile material formed of a series of contiguous frame units each comprising a tubular perimeter adapted to be filled with concrete and a center area circumscribed by the tubular perimeter, provided with filter means capable of preventing the loss of erodible material from the center area while permitting the cultivation of plant life within the center area.

9 Claims, 10 Drawing Figures

EROSION CONTROL MAT

INTRODUCTION

This invention relates to an erosion control mat of textile material adapted to be installed on earth, sand or other erodible material. More particularly, the invention relates to such a mat which can be readily fabricated and installed to protect such surfaces against migration of earth, sand and the like and which can accommodate the seeding and planting of plants or trees.

BACKGROUND OF THE INVENTION

In conventional erosion control systems for the protection of sloped surfaces, it has been customary to assemble precast concrete members of straight bar shape into rectangular or triangular frames along the sloped surface to be protected, or to deposit concrete onto reinforcing bars disposed on the sloped surface to be protected, in rectangular or triangular frame configuration so that stones can be placed, or soil can be deposited for the subsequent planting in the open spaces defined by the frames. However, in such conventional installations, difficult and dangerous work has been required, such as the conveying and fixing of heavy materials on sloped surfaces and, thus, the work proceeds slowly and inefficiently.

To overcome the aforementioned shortcomings associated with such conventional erosion control systems, there has been proposed a mat in which one piece of flexible fabric sheet material composed of single-layer portions, and double-layer portions forming bag-like portions disposed in rectangular or triangular shapes, is placed over the sloped surface to be protected and fluid concrete is introduced into the bag portions defined by the double-layer portion of the sheet so as to form a frame. However, in order to provide the sloped surface protected by such a frame means with plantings, e.g. trees, grass, etc., open portions must be provided by removing the single-layer portions or diagonally cutting the single-layer portions so that seeds can be sown or trees can be planted in said open portions. This results in a large amount of fabric material being removed and wasted.

Accordingly, an object of the present invention is to provide a novel erosion control mat of textile material in which the migration of earth and sand is prevented by seeding and planting open areas defined by an integrated arrangement of frame units without removing or cutting fabric portions to create open areas thereby solving the aforementioned shortcomings associated with conventional erosion control mats.

DETAILED DESCRIPTION OF THE INVENTION

These and other objects and features of the present invention will become obvious from the following detailed description of the invention which includes the best mode presently contemplated for practicing the invention, when taken in conjunction with the accompanying drawings, in which.

Figure 1:
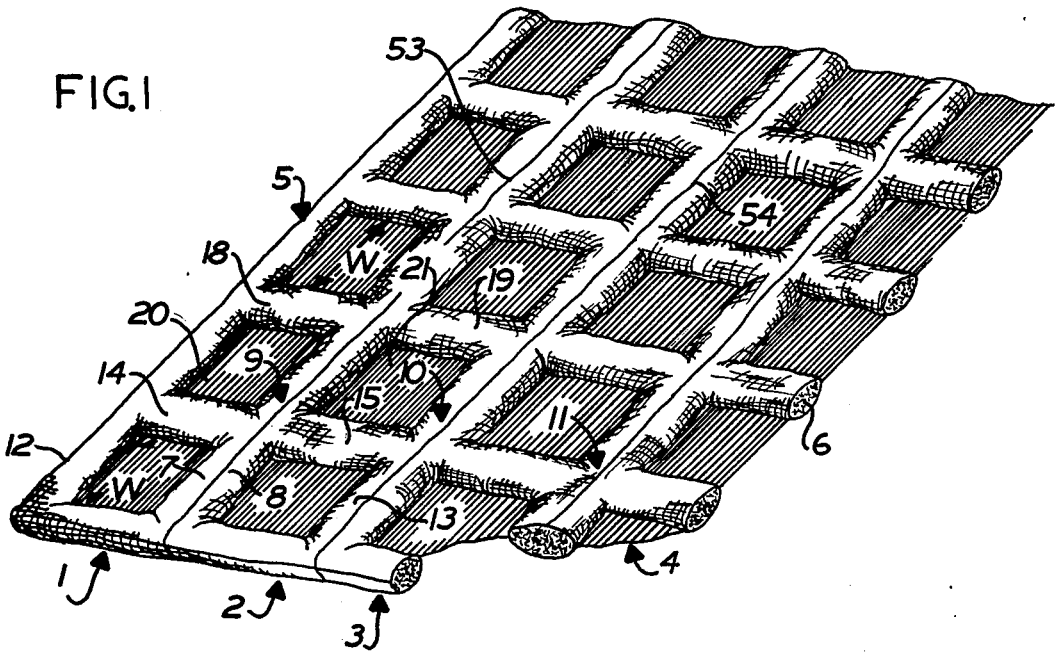
FIG. 1 is a partially broken perspective view of a preferred embodiment of eroson control mat according to the present invention, showing the frame members filled with concrete.

Referring now to the drawings, FIG. 1 shows a portion of erosion control mat 5 according to the present invention, inflated with concrete 6 after having been fabricated by stitching up several frame units some of which are identified generally as 1, 2, 3 and 4, having a construction as shown in FIGS. 2 through 6 and, then, stitching up the outermost peripheral edge of the frame.

Portions of the erosion control mat to be inflated with concrete 6 comprise cylindrical portions some of which are identified generally as 9, 10 and 11, formed for example, by stitching up each pair of opposite left and right halved cylinder forming members 7 and 8 disposed in parallel to each other in the longitudinal direction X of the respective frame units 1 and 2. Other cylinder forming portions 14 and 15, etc. are disposed in the direction perpendicular to the longitudinal direction of said frame units 1 and 2, etc. in parallel to each other at a predetermined interval W and communicating the inner cavities of the respective halved cylinder forming members 12 and 7, and 8 and 13, etc., as shown in FIG. 1. The portions of the frame 5 to be charged with concrete 6 comprising said cylindrical portions joined to each other in the aforementioned manner constitute a framework construction of lattice shape.

In the center areas defined by a tubular perimeter formed of cylindrical portions 9, 10 and 11, etc. disposed in said longitudinal direction and other cylindrical forming portions 14, 15 disposed perpendicularly thereto, there is provided filter means, which in the embodiment illustrated takes the form of a plurality of threads stretched between the cylinder forming portions 14 and 18, and 15 and 19, etc. in parallel to each other in the longitudinal direction so as to form thread rows 20 and 21, etc.

Figure 2:
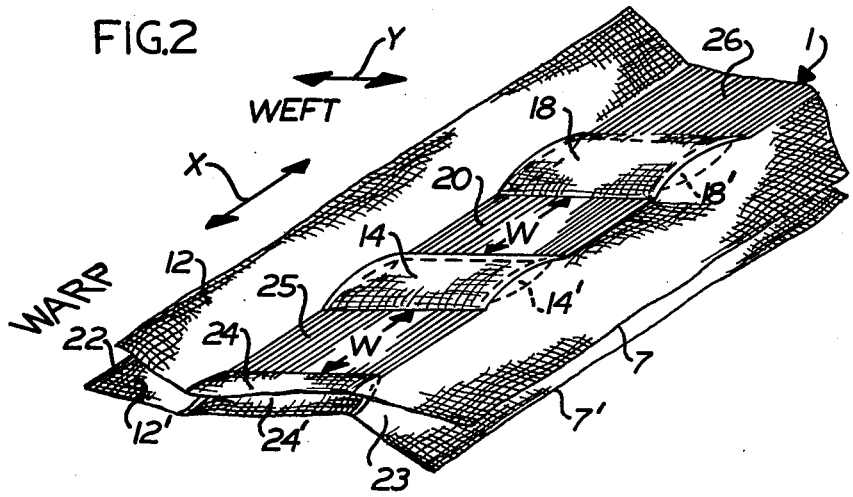
FIG. 2 is a perspective view of a preferred embodiment of an uninflated section of the erosion control mat of FIG. 1.

A preferred embodiment of units 1, 2 and 3, etc. constituting the aforementioned erosion control mat 5 is shown in FIG. 2. Here, the frame unit is composed of left and right halved cylinder forming members 12, 12' and 7, 7' disposed in parallel to each other in the longitudinal direction X, cylinder forming portions 14, 18 and 24 disposed in parallel to each other at a predetermined interval W in the direction Y perpendicular to the longitudinal direction X and communicating the inner cavities 22 and 23 of the respective halved cylinder forming members 12, 12' and 7, 7' and the thread rows 20, 25 and 26 stretched between said cylinder forming members 14, 18 and 24. These frame units 1, 2 and 3 are integrally formed as a series of fabric structures composed of warps and wefts. In the aforementioned structure of the frame unit, the halved cylinder forming members 12, 12' and 7, 7' constitute double-layer constructions of upper and lower layers, respectively. In a similar manner, the cylinder forming portions 14, 18 and 24 form bag-like constructions composed of upper and lower portions 14, 14' and 18, 18' and 24, 24', respectively. In the embodiment illustrated in FIG. 2, the thread rows 20, 25 and 26 are formed of warp rows constituting the cylinder forming portions 14, 18 and 24 in the fabric structure.

The frame units 1, 2 and 3 illustrated in FIG. 2 are woven in a manner as shown in FIGS. 3 through 6.

Figure 3:
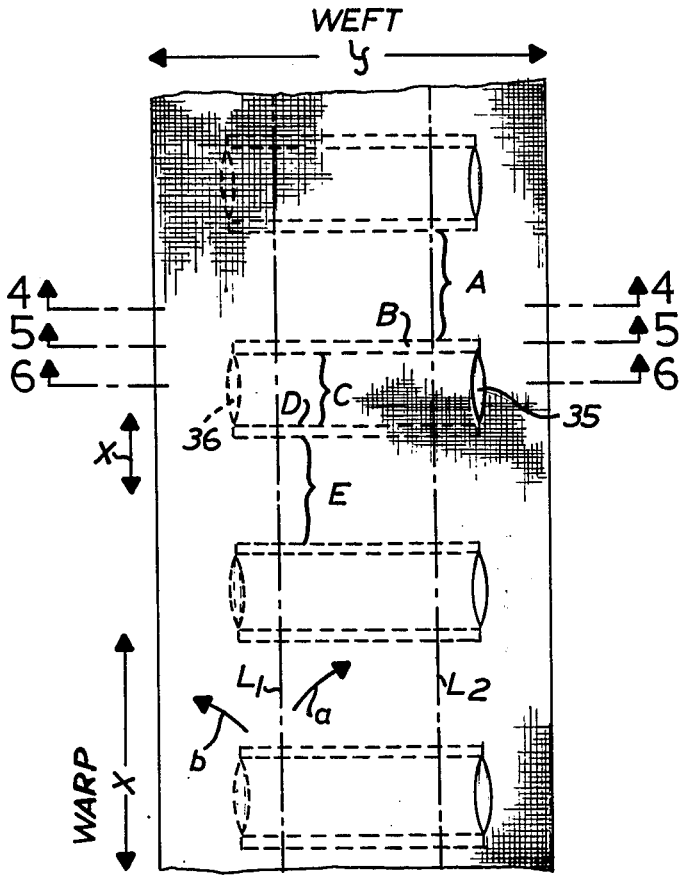
FIG. 3 is a plan view of a fabric blank used to fabricate the uninflated section of FIG. 2.
Figure 4:
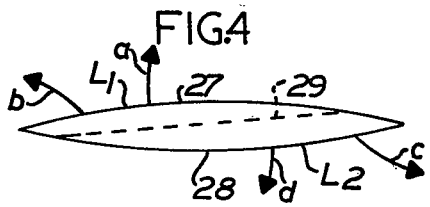
FIGS. 4, 5 and 6 are schematic sections of the fabric blank shown in FIG. 3 taken along the lines IV—IV, V—V and VI—VI in FIG. 3, respectively.

FIG. 3 shows a textile blank material in the woven state thereof. As shown in FIG. 4, in the zone A of FIG. 3, the warps disposed in the longitudinal direction X and the wefts disposed in the direction Y perpendicular thereto are double-woven into an upper sheet 27 and a lower sheet 28, and the warp rows 29 are disposed between said upper and lower sheets.

Figure 5:
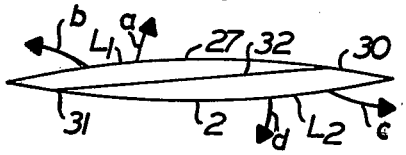

As shown in FIG. 5, in the zone B of FIG. 5, parts of wefts forming the sheets 27 and 28 are folded back at 30 and 31 and woven also into the warp rows 29 so as to form a third sheet portion 32 of a smaller width.

Figure 6:
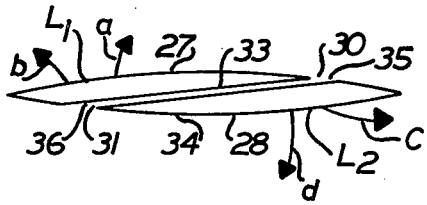

As shown in FIG. 6, in the zone C of FIG. 3, parts of wefts constituting a major part of the sheet 27 are folded back at 30 and woven into parts of the warp rows so as to form the fourth sheet 33, while parts of wefts constituting a major part of the sheet 28 are folded back at 31 and woven into the remaining warps in the warp rows 29 so as to form the fifth sheet 34.

In the aforementioned woven construction, at the sheets 27 and 28, openings 35 and 36 are formed of said fourth sheet 33 and fifth sheet 34 at the double-woven portions.

In the zone D, a fabric structure identical to that in the zone B is formed, while a fabric structure in the zone E is identical to that in the zone A. In this case, the zones B and D may not be necessarily formed, and reinforcing warps may be provided along the side edge portions of the openings 35 and 36.

The textile blank material having the aforementioned double-woven structure has its sheet 27 cut open along the line $L_1$ and its sheet 28 cut open along the line $L_2$, and the respective portions on both sides of said cutting lines $L_1$ and $L_2$ are inverted in the directions of arrows a, b and c, d, respectively, so as to form the halved cylinder forming members 7, 7' and 12, 12' forming the frame unit as shown in FIG. 2.

Figure 8:
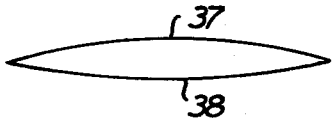
FIGS. 8, 9 and 10 are schematic sections of the fabric blank shown in FIG. 7 taken along lines IIX—IIX, IX—IX and X—X in FIG. 7, respectively.
Figure 9:
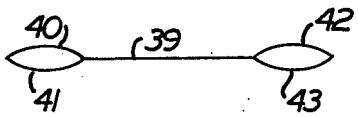

FIGS. 7 through 10 show another preferred embodiment of the fabric structure of the textile blank material forming the frame unit. As shown in FIG. 8, in the zone F, warps disposed in the longitudinal direction X and wefts disposed in the perpendicular direction Y thereto are double-woven into an upper sheet 37 and a lower sheet 38. As shown in FIG. 9, in the zone G, the upper and lower warps and wefts are woven into a unified structure of a sheet 39 of single layer in the center zone H. While, in the zones I and J on the opposite sides of the center zone H, double-woven sheets 40, 41 and 42, 43 are formed in continuation to the sheets 37 and 38, respectively.

In center portion of the zone K, warp rows 44 and weft rows 45 are merely overlapped one on the other without forming a fabric structure, and double woven structure of sheets 40, 41 and 42, 43 are disposed on the opposite sides of the center portion in continuation thereto, respectively.

Figure 10:
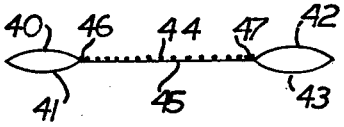
Figure 7:
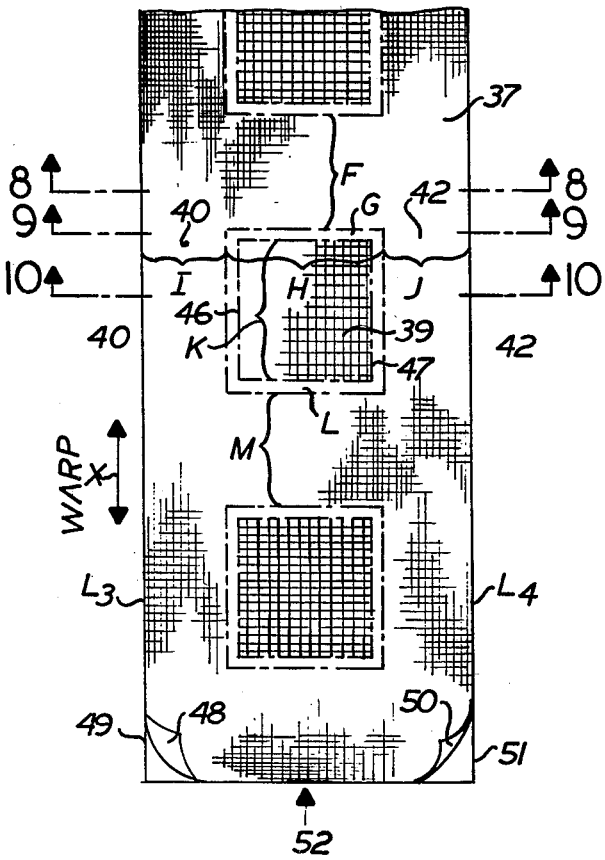
FIG. 7 is a plane view of another fabric blank forming an alternative embodiment of an uninflated section according to the present invention.

In the zone L, a fabric structure identical to that in the zone G is formed, while the fabric structure in the zone M is identical to that in the zone F. In FIGS. 7 and 10, numerals 46 and 47 indicate single-layer sheet portions substantially identical to said single-layer sheet 39, respectively. In this case, these single-layer portions 39, 46 and 47 may not be necessarily formed and may be provided with reinforcing warps.

The textile blank material having the double-woven structure as described immediately hereinabove is cut open along the side edge lines $L_3$ and $L_4$ so as to form upper and lower side members 48, 49, 50 and 51, respectively, as shown in FIG. 7. These side members 48, 49, 50 and 51 correspond to the halved cylinder forming members 12, 12' and 7, 7', respectively, shown in FIG. 2 and form frame unit 52.

Then, a plurality of frame units necessary to cover a predetermined area are disposed side by side and each pair of opposite left and right halved cylinder forming members are stitched up in the manner as shown by the lines 53 and 54, etc. (See FIG. 1).

The resulting erosion control mat having the aforementioned construction is stretched out and laid over the surface to be protected and fixed thereto by suitable anchoring means. Then, concrete is charged under pressure into the inner cavities of the cylindrical portions so that concrete can flow through the inner cavities and be uniformly charged therein to expand said cylindrical portions 9, 10, 16 and 17, etc. forming rectangular frame units as shown in FIG. 1.

As a result of the expansion of the cylindrical portions, the thread rows disposed between the cylinder forming members, namely, the thread rows 20, 25 and 26, etc. including only warps in the embodiment of FIG. 2 and the thread rows including warp rows 44 and weft rows 45 in the embodiment of FIG. 7 are stretched under high tension between the opposite cylindrical portions.

Accordingly, the wider area portions defined by the cylindrical portions 9, 10 and 11 and 14, 15 etc. are covered with thus stretched thread rows under high tension and, the threads prevent the movement of earth and sand thus protecting the surface against erosion.

Further, although the thread rows are stretched under high tension as mentioned above, the ductility of the threads used permits the distance between the threads to be widened for seeding and planting purposes so as to facilitate the planting and cultivation of plant life after installation of the erosion control mat.

If desired a mixture of cultivation soil and seeds, or a thin cement slurry may be injected into the center areas under high pressure so that the injected mixture can penetrate thus stretched threads and be deposited on the earth or sand below.

Although the cylindrical portions 9, 10, and 11 and 14, 15, etc. are shown as regularly disposed in the lateral and longitudinal directions, the disposition of the frame units may be shifted by suitable pitches or the frame units may be slantingly laid so that the frame units can constitute desired combination configurations. Further, the size of the center areas or that of the cylindrical portions 9 and 10, etc. may be varied as desired by merely changing the initial textile structure at the designing stage thereof.

As fully described hereinbefore, the erosion control mat having the aforementioned arrangement and functions according to the present invention can be readily mass-produced in a manner fully satisfying the requirements of protection and stability through well-known weaving means and simple stitching means.

Further, since the erosion control mat according to the present invention is made of woven textile material and, therefore, light in weight, it can be readily stretched out and laid at working sites including steep or high-altitude places. Also, a rigid sloping frame can be formed by merely anchoring the textile sheet and charging the same with concrete, and the center areas in the sloping frame are covered with rows of tensioned threads by said mere concrete charging so that earth and sand on the sloped surface can be prevented from flowing out. In addition, as described previously, not only the distance between the thread rows can be readily widened for the sowing of seeds and the planting of trees for soil conservation purposes, but also this is accomplished with no woven textile material being wasted.

Finally, if it is necessary to use reinforcing steels, the reinforcements can be readily embedded in the ground through the fabric material.

What is claimed is:

1. An erosion control mat of textile material comprising an integrated arrangement of frame units, each unit, forming in cooperation with adjacent frame units a tubular perimeter, hardened cementitious material filling said tubular perimeter, each unit having a generally open center area defined by said tubular perimeter, said center area being provided with filter means effective to prevent the egress of erodible matter while being sufficiently open in structure to permit the cultivation of seeds and seedlings.

2. The erosion control mat defined in claim 1 wherein said filter means comprises a series of generally parallel, unwoven textile strands extending from a first section of tubular perimeter across said center area to a second section of tubular perimeter.

3. The erosion control mat defined in claim 2 wherein said textile strands are extensions of weft or warp strands embodied in said tubular perimeter.

4. The erosion control mat defined in claim 1 wherein said tubular perimeters are rectangular in shape and said filter means comprises a series of unwoven textile strands extending from a section of tubular perimeter forming one side of said rectangle, across said center area, and to the section of tubular perimeter forming the opposite side of said rectangle.

5. The erosion control mat defined in claim 4 wherein said filter means further comprises a second series of unwoven textile strands extending across said center area at right angles to said first mentioned series of textile strands.

6. An erosion control mat of textile material formed of warp and weft textile strands, adapted to be installed on earth, sand or other erodible matter, comprising an integrated arrangement of frame units, each unit forming in cooperation with adjacent frame units a tubular perimeter of woven warp and weft strands adapted to be filled with and to contain fluid cementitious material, each unit having a generally open center area defined by said tubular perimeter, said center area being provided with filter means formed of unwoven textile strands which are continuations of said warp strands, said weft strands or both, whereby said center areas are effective to prevent the egress of erodible matter while being sufficiently open in structure to permit the cultivation of seeds and seedlings.

7. The erosion control mat defined in claim 6 wherein said filter means consists of unwoven warp strands.

8. The erosion control mat defined in claim 6 wherein said filter means consists of unwoven weft strands.

9. The erosion control mat defined in claim 6 wherein said filter means consists of crossed but unwoven warp and weft strands.

* * * * *